US009103632B1

(12) United States Patent
Larson

(10) Patent No.: US 9,103,632 B1
(45) Date of Patent: Aug. 11, 2015

(54) ARCHERY SIGHT

(71) Applicant: Larson Archery Company, Ogden, UT (US)

(72) Inventor: Marlow W. Larson, Ogden, UT (US)

(73) Assignee: Larson Archery Company, Ogden, UT (US)

( * ) Notice: Subject to any disclaimer, the term of this patent is extended or adjusted under 35 U.S.C. 154(b) by 0 days.

(21) Appl. No.: 14/222,238

(22) Filed: Mar. 21, 2014

(51) Int. Cl.
*F41G 1/467* (2006.01)

(52) U.S. Cl.
CPC ..... *F41G 1/467* (2013.01)

(58) Field of Classification Search
CPC ..... F41G 1/467; F41G 1/345; F41G 1/473; F41G 1/01; F41G 1/54; F41G 1/08; F41G 1/10; F41G 1/32; F41G 1/44; F41G 1/545; F41G 5/14; F41G 5/143; F41G 5/066; A63B 2244/04; A63B 2243/0029; A63B 2244/03; A63B 2244/19; A63B 9/00; A63B 69/0093; A63B 69/3685
USPC ..... 33/265; 124/87
See application file for complete search history.

(56) References Cited

U.S. PATENT DOCUMENTS

| | | | | |
|---|---|---|---|---|
| 3,212,190 | A | 10/1965 | Larson | |
| 3,997,974 | A | 12/1976 | Larson | |
| 4,884,347 | A | 12/1989 | Larson | |
| 5,676,122 | A * | 10/1997 | Wiseby et al. | 124/87 |
| 6,725,854 | B1 * | 4/2004 | Afshari | 124/87 |
| 6,823,597 | B2 | 11/2004 | Larson | |
| 7,392,590 | B2 * | 7/2008 | Gordon | 33/265 |
| 7,574,811 | B2 * | 8/2009 | Kurtzhals et al. | 33/265 |
| 8,099,874 | B2 * | 1/2012 | Priebe | 33/265 |
| 8,151,473 | B2 * | 4/2012 | Sims et al. | 33/265 |
| 8,166,662 | B2 * | 5/2012 | Williams | 33/265 |
| 8,561,308 | B2 * | 10/2013 | Adams et al. | 33/265 |
| 8,904,655 | B1 * | 12/2014 | Larson | 33/265 |
| 2006/0156561 | A1 * | 7/2006 | Afshari | 33/265 |
| 2013/0247399 | A1 * | 9/2013 | Evans | 33/265 |

OTHER PUBLICATIONS p. 32 from Browning Archery USA Catalog, 1993.

* cited by examiner

*Primary Examiner* — Yaritza Guadalupe-McCall
(74) *Attorney, Agent, or Firm* — Brian C. Trask

(57) ABSTRACT

An archery sight with a plurality of sight pins and a perimeter guard essentially surrounding the pins. The sight can be structured such that a first sight pin is disposed at a fixed position, relative to the guard, at a plurality of sight-in distance configurations for the first sight pin. In that case, the position of at least a second sight pin is changed, relative to the guard, as a sight-in distance configuration is changed for the first sight pin. Sights may provide visual cant and/or yaw feedback for an archer. Some guards may be partially or virtually enclosed to resist damage to sight pins or other internal mechanisms, and may provide visual magnification.

20 Claims, 4 Drawing Sheets

ARCHERY SIGHT

BACKGROUND

1. Field of the Invention

This invention relates to sighting devices for ballistic projectiles. It is particularly directed to a sight adapted for use in the field of archery.

2. State of the Art

Pin sights are in extensive use by archery hunters. Several versions have evolved over the years, in response to the changing demands of the marketplace. A principal driving force for pin sight development has been the advancing technology of the archery bows, with which those sights are used.

A traditional fixed-pin sight usually has 3 to 5 pins, which can be individually set for a particular known distance (yardage). The top pin establishes a selected yardage distance, and progressively lower pins establish correspondingly longer distances. Once set, the pins are tightened and remain "fixed" in position during use. Setting up and adjusting a fixed-pin sight is relatively straight forward, but requires some trial and error testing.

Typically, the group of sight pins is disposed within, and protected by, a guard. It is desirable for the group of pins to be spread-out to reasonably optimize the space available inside the guard. Selection of the sighted-in location for a first pin with respect to the guard is important to permit a desired number of pins to be used, and to avoid skewing the group of pins to one side of the guard. If an archer misjudges a first pin location (e.g. for a close target), it is possible that a pin for a different target (e.g. far-away) might not even fit inside the guard. Consequently, all of the pins must be moved and re-sighted in.

BRIEF SUMMARY OF THE INVENTION

Preferred embodiments of this invention provide an archery bow sight including a plurality of sight pins and a protective guard disposed to protect a volume of space in which those sight pins operate. A portion of each sight pin establishes a pin aim point for a designated sight-in distance. The archer will align a respective pin aim point with the spot on a distant target at which an arrow is desired to strike or land. A first sight pin (e.g. a mid-range sight pin), is structurally coupled with the guard effective to maintain the first sight pin aim point at a substantially fixed location with respect to the perimeter of the guard as the first sight pin is adjusted in elevation to establish its aim point at a selected target distance. The relative location of the aim point of a second sight pin is consequently changed, with respect to the perimeter, as the first sight pin is adjusted in elevation.

In certain cases, the fixed location of the first sight pin aim point may be disposed substantially at the centroid, or middle, of an area defined by a cross-section of the guard. Certain operable guards may have a generally rectangular cross-section, or resemble a round-ended elongate slot, or may suggest any other workable cross-section geometry. More preferably, a guard defines a substantially circular cross-section area, and an aiming point defined by the first sight pin can be disposed substantially at the center of that circular cross-section area. The diameter of a circular perimeter may be selected in harmony with the aperture size of a peep sight embedded in the bow string to provide cylindrical visual reinforcement of a consistent anchor position. It can be beneficial to statistical accuracy if the most commonly used sight pin aim point is disposed near to the sight axis center of a cylindrically reinforced sight arrangement.

In a currently preferred embodiment, the guard is affixed to elevation-adjustable structure associated with the aforementioned first sight pin. In one workable embodiment, a guard is affixed to a first pin arm that is adjustable in elevation by a screw mechanism associated with a cage.

It is generally desirable for a bow to be sighted-in, and shot, while disposed in a repeatable vertical orientation. That is, cant (or deviation of the bow limbs from a common vertical plane), is generally undesirable. Sometimes, embodiments of a sight according to certain principles of the invention may include cant-indicating structure to provide feedback to an archer during aim of a bow on which the sight is affixed. One operable cant-indicating structure includes a bubble level. Preferably, the bubble level is disposed inside the perimeter of the guard. One aspect sometimes provided by a single "fixed" pin, is that the other pins may be operably distributed within the limited area confined within the guard, without visually or structurally interfering with the bubble level.

For example, it is within contemplation that a pin associated with a "longest shot" may be "fixed", with respect to a guard perimeter, at a desirable and workable location near a bubble level. That "longest shot" pin can then be sighted-in, and the guard will be positioned accordingly. All other sight pins can then be individually adjusted with respect to the guard perimeter, as required, to locate each pin's aim point in correspondence with the arrow strike location at a desired closer target range. Consequently, the collection of sight pins may be automatically and optimally spread out inside the perimeter of the guard.

Another workable cant-indicating device includes a pendulum structured to depend from a top portion of the guard in vertical alignment (and along the sight axis) with a plurality of vertically disposed individual pin aim points when an archery bow, on which the sight is installed, is properly oriented to aim a drawn arrow. Sometimes, the cant-indicating pendulum may be offset by a distance from the pin aim points, in a sight axis direction, effective to provide a visual yaw feedback to an archer. Yaw feedback can encompass parallel and offset disposition of the pendulum's blade from the vertical collection of aim points, and/or a double line (parallel vertical lines) indicated by front and rear edges of a pendulum blade.

A pendulum element may include a weight disposed at its free end. Sometimes, the weight may have magnetic properties, and the sight assembly can include a magnet structured for disposition at a first position to resist motion of the pendulum, and for disposition at a second position to permit motion of the pendulum. It is within contemplation to provide stops to confine motion of a pendulum to within a desired range.

Embodiments of a sight according to certain principles of the invention may include one or more lens coupled to the guard effective to resist passage of an object through the guard in a sight-axis direction. A workable lens may include a magnifying lens. Certain embodiments of a guard may substantially enclose a volume in which the sight pins, and sometimes one or more other mechanism, operate. For example, in certain cases, a pendulum element may also be contained inside the enclosed volume.

Suppression of noise is important in a bow hunting environment. Therefore, preferred archery sights are structured to resist noise generation. Sometimes, structure associated with a vertical displacement of the guard can be biased into engagement with anti-rotation structure at a first position effective to resist rotation of the guard about a length axis of a screw mechanism as the screw mechanism is adjusted in a first direction. Structure associated with vertical displacement of the guard can also be biased into engagement with anti-rotation structure at a second position effective to resist rotation of the guard about a length axis of the screw mechanism as the screw mechanism is adjusted in a second direction.

In one workable embodiment, a guard is biased into engagement with first anti-rotation structure at a first position effective to resist rotation of the guard about a length axis of a screw mechanism as the screw mechanism is adjusted in a first direction. The first anti-rotation structure can include an element of a cage in which the screw mechanism is held. The first pin arm is also biased into engagement with second anti-rotation structure at a second position effective to resist rotation of the guard about a length axis of the screw mechanism as the screw mechanism is adjusted in a second direction. The second anti-rotation structure may include a cage element that interferes with a carriage element associated with the sight pin.

It is desirable for pins to be vertically adjustable individually and without significant wobble. A workable screw mechanism to reduce pin wobble includes an elongate and internally threaded dowel element affixed to a first sight pin arm. The dowel element extends transversely to a pin arm length axis of the first pin arm for reception of the dowel element in translating penetration through a portion of a cooperating second pin arm during operation of the screw mechanism. Consequently, wobble of the pin is reduced by a factor determined by the length of the dowel element compared to the thickness of the pin arm. Further, adjacent pin spacing can be as close as the thickness of a pin arm. Of course, other arrangements that provide closer pin spacings are known and workable.

Preferred embodiments include one or more global mechanism operable to adjust a position, such as for windage and elevation, of the sight pins as a group. Also, it is desirable to include fiber optic elements structured to visually accentuate individual pin aim points. In any case, it is desirable that a vertical adjustment of each sight pin may be effected individually to establish a plurality of pin aim points corresponding to respective target distances.

The invention may be embodied in a plurality of different ways, each of which may emphasize one or more different principle of operation. One embodiment forms an archery sight with a plurality of sight pins disposed inside a perimeter defined by a guard, with only one sight pin being disposed at a fixed location, relative to the perimeter, at a plurality of sight-in distance configurations for that sight pin, and with the sight-in distance configuration of that sight pin being fine-tunable by action of a screw mechanism.

Another embodiment provides an archery sight with a plurality of sight pins and a perimeter guard surrounding the pins. That sight is structured such that a first sight pin is disposed at a fixed position, relative to the guard, at a plurality of sight-in distance configurations for the first sight pin. Also, a position of a second sight pin is changed, relative to the guard, as a sight-in distance configuration is changed for the first sight pin.

BRIEF DESCRIPTION OF THE DRAWINGS

In the drawings, which illustrate what are currently considered to be the best.

MODES FOR CARRYING OUT THE INVENTION

Figure 1:
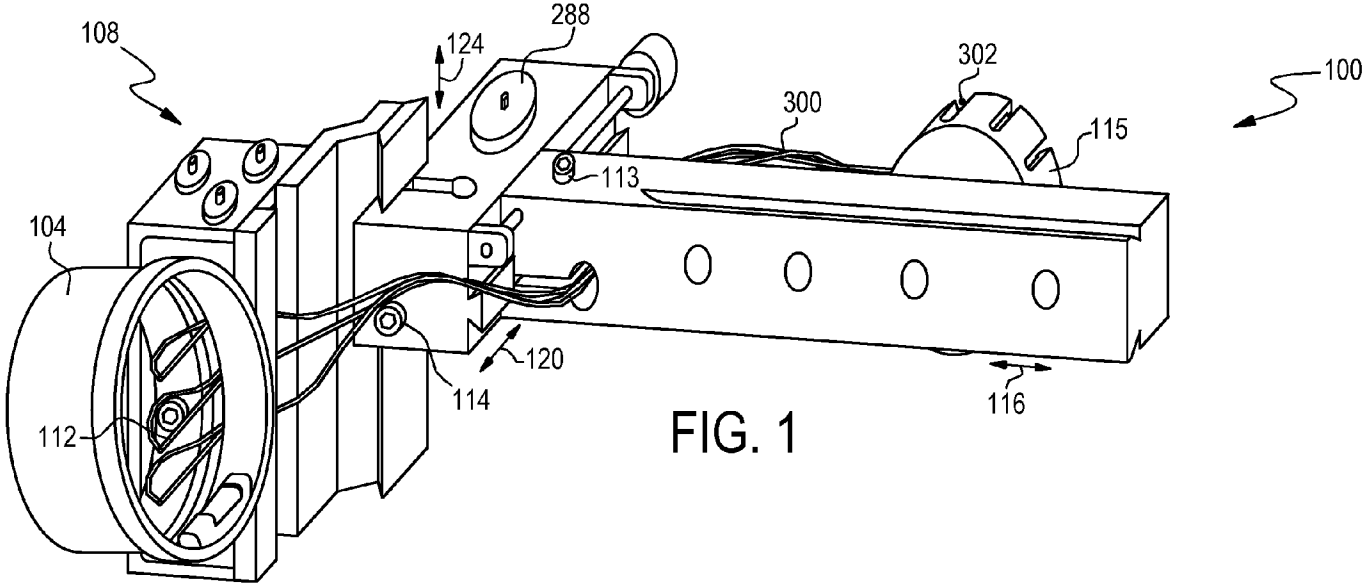
Figure 10:
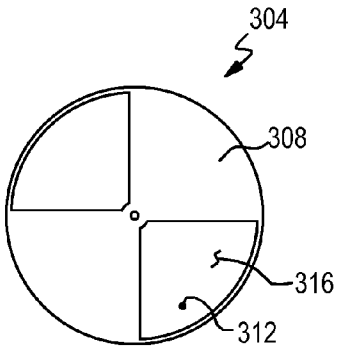
Figure 2:
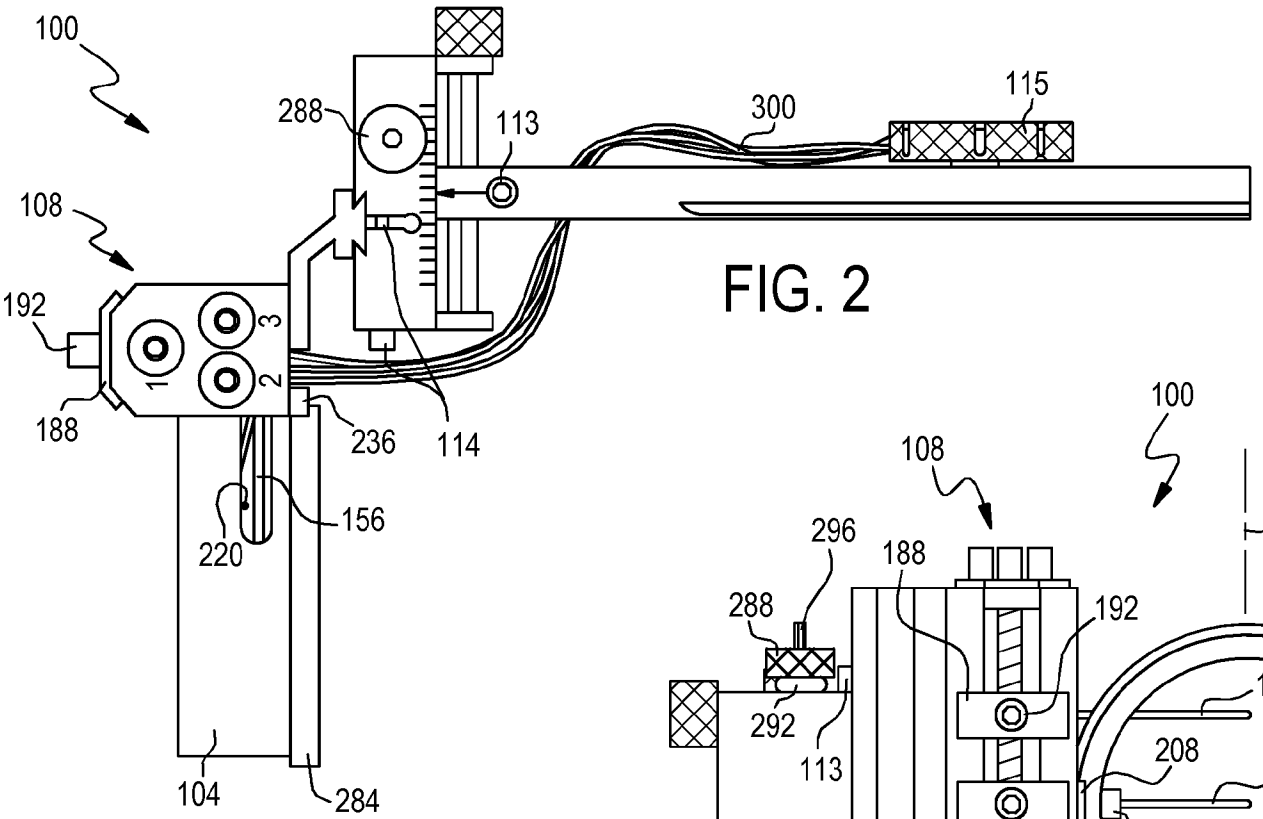
Figure 3:
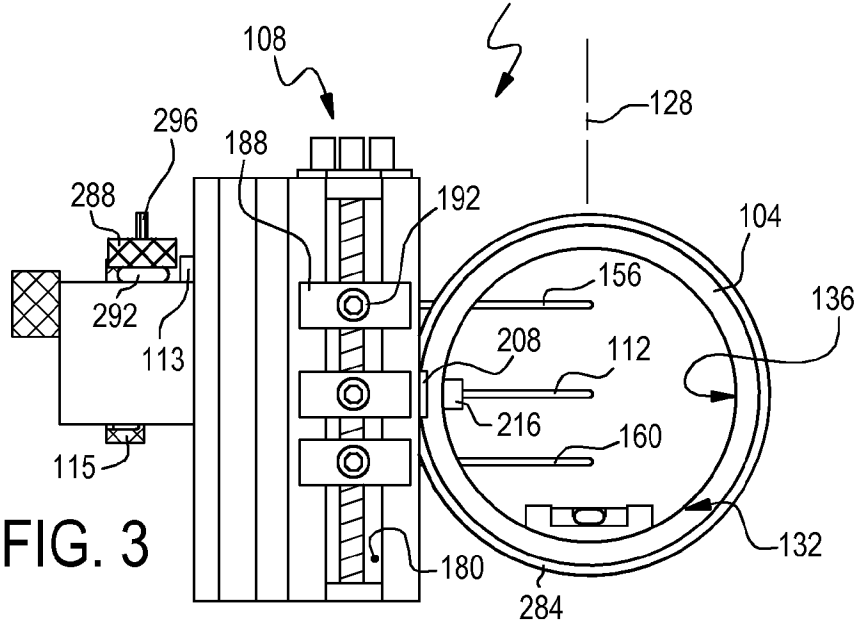
Figure 4:
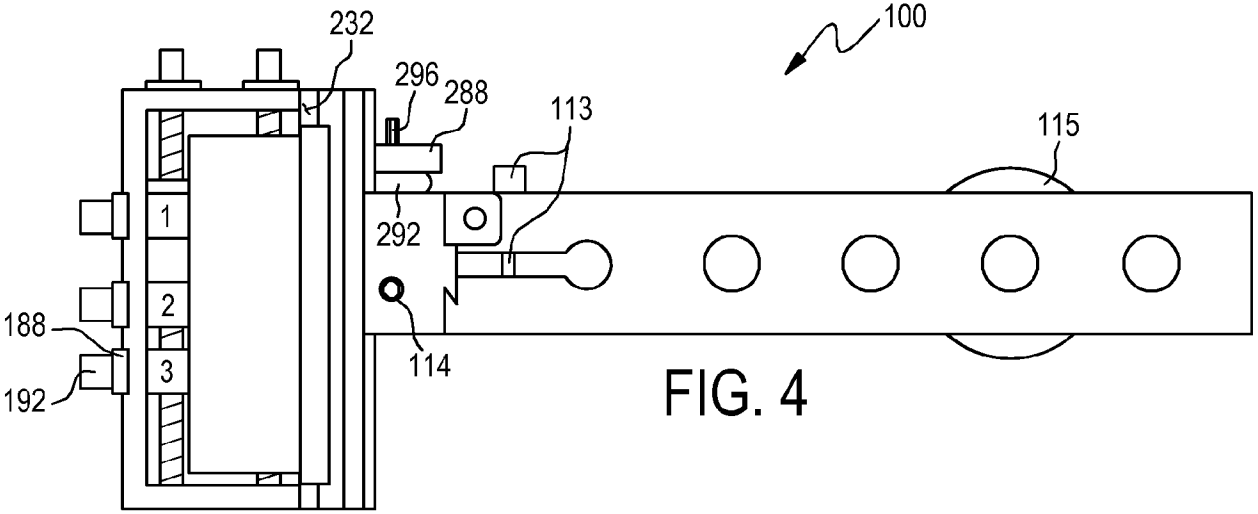
Figure 5:
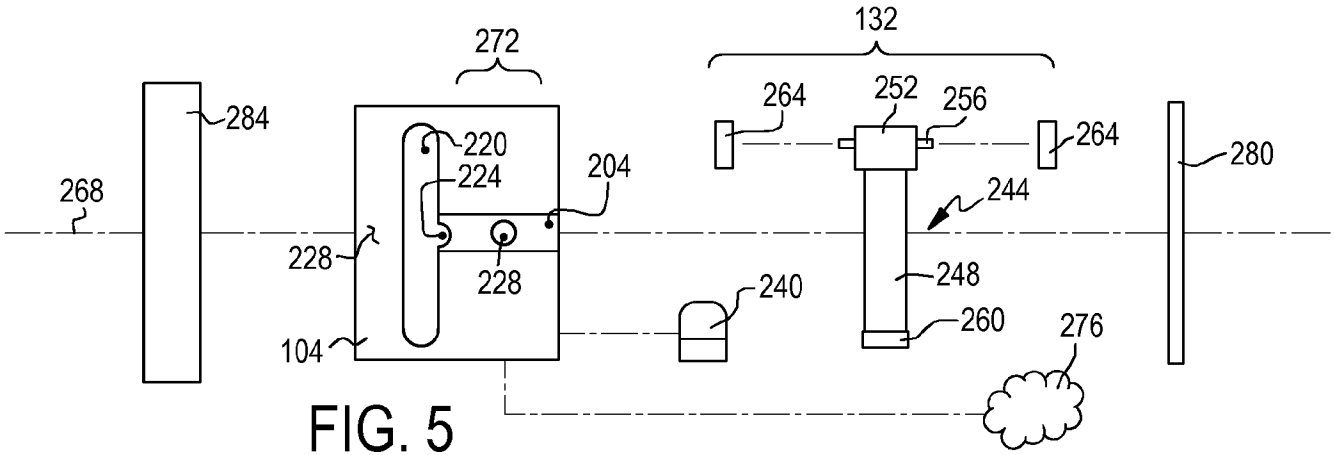
Figure 8:
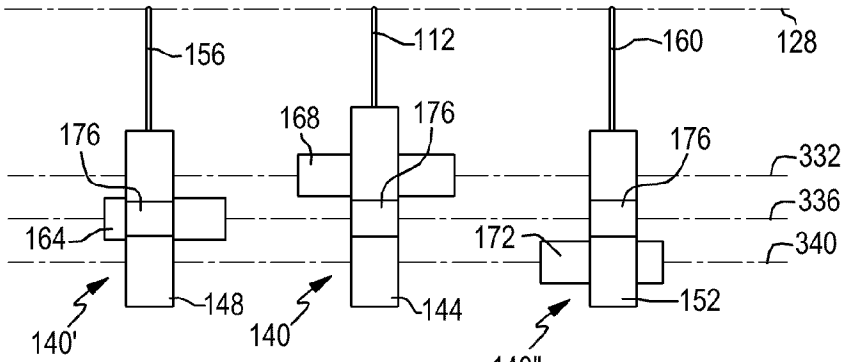
Figure 7:
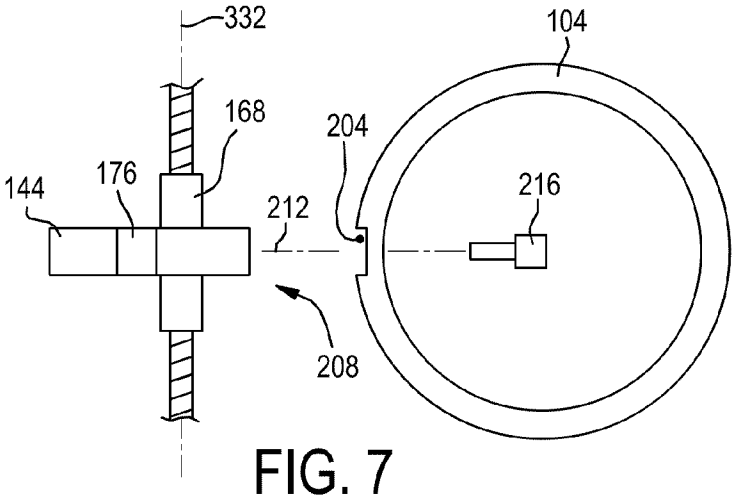
Figure 6:
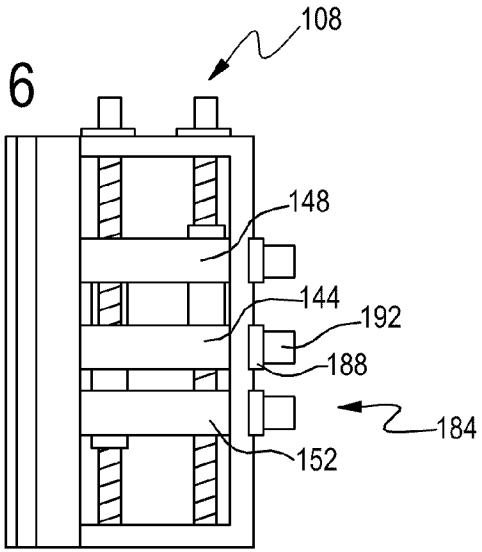
Figure 9:
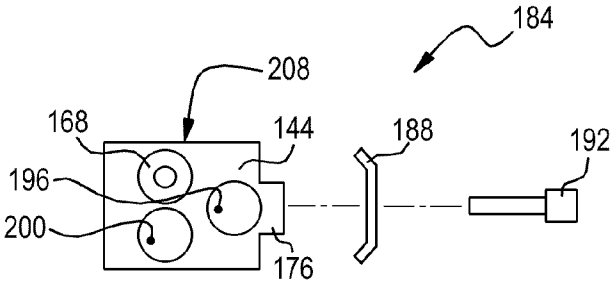

FIG. 1 is a view in perspective of a currently preferred embodiment;

FIG. 2 is a top view of the embodiment in FIG. 1;

FIG. 3 is a front end view of the embodiment in FIG. 1;

FIG. 4 is a left side view of the embodiment in FIG. 1, with the fiber optic elements removed;

FIG. 5 is an exploded right side view of a workable guard for the embodiment in FIG. 1, and including certain optional elements;

FIG. 6 is a right side view of the cage portion of the embodiment in FIG. 1;

FIG. 7 is an exploded front end view of a portion of the embodiment in FIG. 1;

FIG. 8 is an exploded assembly front view (rotated CCW 90 degrees) of pin arms of the embodiment in FIG. 1;

FIG. 9 is a top view of a portion of the central pin arm in FIG. 8;

FIG. 10 is a right side view of an optional light-blocking cover; and

Figure 11:
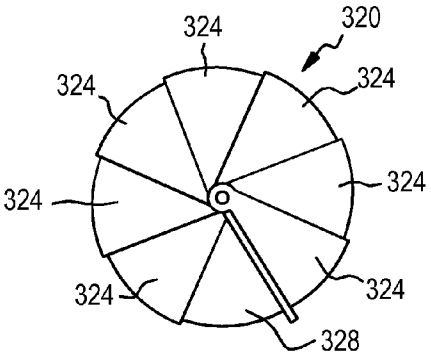

FIG. 11 is a right side vice of an alternative light-blocking cover.

DETAILED DESCRIPTION OF THE ILLUSTRATED EMBODIMENTS

Reference will now be made to the drawings in which the various elements of the illustrated embodiments will be given numerical designations and in which the invention will be discussed so as to enable one skilled in the art to make and use the invention. It is to be understood that the following description is only exemplary of certain principles of the present invention, and should not be viewed as narrowing the claims which follow.

Orientations in the drawings are made with reference to a sight that is installed on an archery bow, and the bow is aimed at a target. The front is the surface closest to the target. The back is closest to the archer. Top and bottom are with reference to a bow held in a conventional shooting orientation on level ground. Left and right correspond to the archer's left and right sides.

A currently preferred embodiment, generally indicated at 100, of an archery sight structured according to certain principles of the invention is illustrated in FIGS. 1-4. Sight 100 includes a guard 104, inside of which a plurality of sight pins are operably disposed. Although three are illustrated, any workable plural number of sight pins may be included in a sighting apparatus structured according to principles of the invention. Illustrated guard 104 is continuous around its perimeter. However, alternatively-structured and discontinuous guards can be workable. One function of a guard 104 is to resist accidental departure of a sight pin aim point from a desired sight-in configuration due to an accidental encounter with external structure, such as a tree limb.

Preferably, a fine-tuning mechanism, generally 108, is included to permit an archer to make an accurate and tiny elevation adjustment of each individual sight pin. As will be described in more detail below, only one sight pin 112 is permanently fixed in position, or location, with respect to the guard 104. That pin may be adjusted in elevation (e.g. using a portion of mechanism 108 to change a sight-in distance configuration of pin 112), to place a pin aim point of pin 112 in correspondence with the arrow strike location at a designated target distance. The relative location of a second sight pin is consequently changed, with respect to the guard 104, as the elevation of first sight pin 112 is adjusted with respect to the bow on which sight 100 is installed.

Desirably, provision is made to permit making large, or coarse, adjustments to an installed position of the guard 104 to fit the sight 100 onto different archery bows. With reference to FIG. 1, dovetail slide mechanisms permit making a 3-dimensional adjustment in space to position the guard 104 at a desired position with respect to a bow riser, or handle. Other types of adjustment mechanisms are well known and workable. After the sight 100 is located at a generally desired position on a particular bow, it is desirable to lock the global adjustment mechanisms. To accomplish that, the illustrated embodiment includes clamping mechanisms actuated by socket head cap screws 113 and 114, and knurled wheel 115.

A global front-rear position adjustment is indicated by arrow 116. A global windage adjustment is indicated by arrow 120. And finally, a global elevation adjustment is indicated by arrow 124. These orthogonal adjustments are characterized as "global", because each adjustment simultaneously changes the position of all sight pins to the same degree. Certain global adjustments may further be characterized as "coarse", or having reduced precision in causing a desired increment between fixed positions. In contrast, mechanism 108 permits making a separate and "fine" elevation adjustment to the position of each individual sight pin.

A sight 100 constructed according to certain principles of the instant invention may include two or more sight pins. With particular reference now to FIG. 3, it is desirable for the aiming structure, or target-indicating portion (the pin aim point), of all sight pins to align along a vertical axis 128. Typically, vertical axis 128 passes at least approximately through the middle of a visual apurture defined by guard 104. It is also desirable to include some sort of cant-indicating device, generally indicated at 132, to provide vertical bow orientation feedback to an archer. As a currently preferred design principle, either one or more pins should be horizontally adjustable to compensate for an archer's habitually canted bow, or all aim points should be vertically aligned, and a visual cant feedback mechanism should be included in a sight.

It is further desirable for one pin, e.g. pin 112, to be disposed at a fixed position or location with respect to the perimeter 136 of a guard 104. Pin 112 may sometimes be characterized as a mid-range indicator, in which case it indicates an aim point for a mid-range target. The fixed pin may alternatively centrally-position a pin corresponding to the most commonly used, or expected, target range. The target range of a particular designated fixed pin may be determined by other factors, including archer preference.

The perimeter 136 of guard 104 illustrated in FIG. 3 is generally circular. The currently preferred fixed position for the target-indicating portion of pin 112 (the pin aim point) is at least approximately near the center of a circular perimeter 136. In the case where the perimeter 136 of an alternative guard is some other shape, such as rectangular, the fixed indicator is preferably disposed approximately near the middle, or centroid, of a visual aperture defined by the alternative guard's cross-section shape. That central position of one fixed pin can maximize room in which to distribute the remaining pins, and thereby provide target aim points disposed within the perimeter of a guard and in suitable correspondence with maximum-to-minimum operable range of the bow.

Illustrated fine-tuning mechanism 108 includes three threaded lead screws, each screw shaft driving a designated sight pin carriage to effect a vertical adjustment of a respective sight pin. A number may be assigned to each screw, and affixed to a sight 100, such as numbers 1-3 in FIGS. 2 and 4. That affixed number can help an archer to make location adjustments to a desired sight pin. Individual sight pins can identified with their respectively numbered lead screws. To further associate a particular lead screw with its designated pin, a swath of color can be affixed to each lead screw control interface, and that affixed color can coordinate with the color of a fiber optic cable associated with that pin, or with a corresponding color swath applied to that pin.

A sight pin arm, generally indicated at 140, 140', and 140" in FIG. 8, includes structure generally associated with movement of a sight pin aim point. In the illustration set forth in FIG. 8, sight pin arm 140 includes a sight pin carriage 144 and cantilevered sight pin 112. Desirably, the individual pins are all fixed to their respective carriage to dispose their respective aim points in vertical alignment and in a common plane of operation. That is, registration of pin aim points in a common vertical plane is controlled by manufacture of the currently preferred sight 100; no pin-specific windage user adjustment is provided in currently preferred embodiments. Windage adjustment for a preferred sight is effected on all pins simultaneously with a global mechanism.

The free end of pin 112 provides any sort of workable target-aiming structure in accordance with well-known convention, including beads and the like. Preferred embodiments include a light gathering element, such as a fiber end of a fiber optic cable, structured to accentuate a pin aim point. The end of a fiber of a fiber optic cable produces an illuminated spot, or pin aim point. During the sight-in process, the archer aligns a selected aim point with a location on a distant target where an arrow should land. The vertical adjustment of a pin changes its sight-in distance configuration. Individual pins are conventionally adjusted in elevation to place their pin aim points in correspondence with discrete arrow-strike locations on targets that are incrementally spaced apart. Assuming the archer has a consistent anchor, each pin aim point then corresponds to the arrow strike location at a designated sight-in distance. Conventional increments between sight-in distances between adjacent pins are between 5 and 15 yards. A sight such as illustrated in FIG. 1, and having three sight pins, might have its pins adjusted in elevation to be sighted-in on targets disposed respectively at 30, 40, and 50 yards.

With particular reference to FIGS. 6, 8, and 9, the illustrated mechanism 108 includes three carriages 148, 144, and 152 in top-to-bottom order, and corresponding to sight pins identified on the sight 100, itself, as pins 1-3. Top carriage 148 carries cantilevered close-distance sight pin 156. Bottom carriage 152 carries long-distance pin 160.

It is generally desirable to structure a carriage in a way that reduces pin wobble, which introduces uncertainty in aim-point accuracy during adjustment in individual pin elevation. One way to reduce pin wobble includes equipping each carriage with an elongated dowel member that is internally threaded to receive a corresponding lead screw drive. For example, carriage 148 is affixed to dowel 164; carriage 144 is affixed to dowel 168; and carriage 152 is affixed to dowel 172. The elongated dowel (compared to the thickness of a carriage) reduces pin wobble due to a desirably loose fit between threads of the dowel and threads of its associated lead screw. A dowel may be press-fit into engagement in a carriage.

With particular reference to FIGS. 8 and 9, each carriage 148, 144, and 152 includes an optional projecting tongue 176, that is structured to fit in close sliding relation inside slot 180 (see FIG. 3). Tongue 176 and slot 180 are exemplary structures that may cooperate to resist pin wobble, e.g. resulting from actuation of its associated lead screw drive. Alternative wobble-resisting structures are within the ability of, and will occur to, one of ordinary skill in the art.

With reference to FIGS. 6 and 9, a lock mechanism, generally 184, may be provided to lock a carriage and pin at a desired sighted-in position. Once a carriage is in a locked position, wobble of its associated pin is essentially avoided.

Lock mechanism 184 includes a bridge washer 188 and a fastener 192, such as a socket head cap screw.

It can be desirable for adjacent sight pins to be close together. Therefore, a first carriage may be structured to accommodate transverse passage of an elongate dowel that is carried by a second, or any other, carriage. As illustrated in FIG. 9, carriage 144 carries dowel 168. A first through-hole 196 in carriage 144 is structured to slidingly receive dowel 164 carried by top carriage 148. Similarly, a second through-hole 200 in carriage 144 is structured to slidingly receive dowel 172 carried by bottom carriage 152. Top and bottom carriages 148 and 152 are similarly structured to slidingly receive dowels carried by any other carriage. Therefore, each adjacent sight pin can be spaced apart by essentially the thickness of a carriage. Alternative arrangements that permit even closer pin spacing are known, and are operable in embodiments of the invention.

FIG. 7 illustrates one way to associate a guard 104 with a sight pin arm 140. As illustrated in FIG. 7, a dado 204 formed in guard 104 is structured to receive a cooperating end portion, generally 208, of carriage 144. Close agreement between end 208 and dado 204 holds guard 104 effective to resist rotation of guard 104 about joint axis 212. The connection between guard 104 and carriage 144 can be secured using a press-fit, adhesive, and/or a fastener 216, and the like. When affixed to pin arm 140, guard 104 will inherently travel in concert with any displacement of pin 112. Adjustment of the elevation of pin 112 using mechanism 108 does not change the elevation of any sight pin other than pin 112 (e.g. with respect to the bow on which sight 100 is installed). Consequently, the elevation of all other sight pins will be changed (with respect to perimeter 136), as the elevation of pin 112 (and guard 104), is changed (with respect to the bow), by fine-tuning mechanism 108.

With reference now primarily to FIG. 5, a guard 104 desirably includes a vertically disposed slot 220, along the major axis of which the sight pins may be vertically displaced within their zone of operation. A detent 224 may be provided to facilitate passage of a fiber cable element from its end point at a sight aiming location toward the proximal end of the sight 100. An aperture 228 is provided to receive fastener 216.

In certain cases, installation of fastener 216 is effective to bias a portion of guard 104 against structure of the sight 100 effective to resist vibration and attendant noise. In the illustrated embodiment 100, surface 228 of an installed guard 104 is biased against surface 232 (FIG. 4) of vertical bar element 236 (FIG. 2) of the cage in which fine-tuning mechanism 108 is disposed. Biased engagement between cooperating elements can reduce vibration and noise. The biased guard 104 can also cause another interference of structure of a sight arm and a structural element of a sight 100. Therefore, hysteresis can be removed from the up-and-down operation of adjusting the guard 104 (and sight pin 112).

FIG. 5 also illustrates certain optional features that may be associated with a guard 104. Optional cant-indication structure, generally indicated at 132, may include a bubble level 240, or a pendulum, generally 244. A workable pendulum 44 may include a blade 248, hub 252, pivot axle 256, and an optional weight 260. Pivot axle 256 may be captured by oppositely disposed device elements 264. Clevice elements 264 may be affixed to the inner top surface of guard 104 to capture axle 256 and permit oscillation of blade 248, or otherwise be disposed in operable association with the guard 104. Desirably, an edge of blade 248 of pendulum 244 is disposable to align vertically with pin aim point orientation axis 128 when an archer is looking along a substantially horizontal sight axis 268. When a sight is properly oriented, blade 248 is essentially disposed in the sight plane, which contains vertical axis 128 and sight axis 268.

A workable blade element may be formed from a section of thin fluorescent plastic plate, or sheet material. A small diameter strand may also be workable. Desirably, the thickness of the blade 248 is not so thick as to interfere with an archer's view of the target, but does provide a visual centerline indication of a vertical axis. Vertical alignment of the collective sight pin aim points with an indication provided by blade 248 ensures that the bow is disposed in a proper vertical orientation.

It is sometimes desirable to provide an axial offset, generally 272, between the plane of aim-indication structure of the sight pins and a thin planar blade 248 to provide a visible yaw indication to an archer. Front and rear edges of a planar blade will coincide (and thereby desirably present a single centerline image to the archer) when there is no yaw. Also, yaw can be indicated if a centerline defined by a vertical blade is disposed offset from, and parallel to, vertically aligned aim points.

In certain cases, optional weight 260 can be a magnetically attracted element. In that event, element 276 may be a magnet, which can be disposed to urge blade 248 toward a neutral position. The magnet 276 is typically removable to permit oscillation of the pendulum. Placement of the magnet 276 in an installed position can be effective to maintain the blade 248 in a straight condition, e.g. during long-term storage of the sight in a non-vertical orientation. Alternatively, element 276 may be embodied as a cage to resist the amount of travel of the free end of a pendulum 244.

It is within contemplation that a guard 104 may include one or more barrier to resist passage of an object through a guard or housing 104 in the direction of sight-axis 268. A workable barrier includes front lens 280 and/or rear lens 284. Either, or both, of lens 280, 284 may be a magnifying lens, or they may simply be transparent plates. Illustrated rear lens 284 includes a collar that engages guard 104. Desirably, a lens may be removed from attachment to a guard 104 to permit cleaning of the lens.

It is helpful to provide a tool 288 to assist in tightening and releasing various fasteners forming a sight 100. A threaded connection between a tool 288 and sight 100 forms a convenient means to associate the tool 288 with a sight 100 for storage. A non-visible arm of tool 288 is threaded for reception in a cooperating threaded socket in sight 100. As illustrated in FIGS. 3 and 4, a surface of tool 288 may be spaced from engagement with sight 100 by an O-ring 292 to resist vibration, avoid noise creation, and to resist undesired removal of a tool 288 from its installed position. A tool 288 may include an Allen wrench 296 of different size on each of its sides (one being disposed inside sight 100). For example, an Allen wrench of one size may operate a selected lead screw of mechanism 108, and the other size Allen wrench may operate a clamping fastener, such as cap screw 113.

With reference again to FIG. 1, fiber optic cable 300 includes three fiber elements. Each sight pin aim point for sight 100 is defined by an illuminated dot at one end of a fiber element. The opposite, free end, of cable 300 may be disposed in a manner that maximizes light-gathering opportunity for the cable 300. For example, a length of cable 300 may be coiled on, or in, a drum associated with the sight 100. In FIG. 1, free end of cable 300 is stored coiled-up inside a drum formed by the rim of knurled wheel 115. As illustrated, wheel 115 may be configured something like a castle nut. After wheel 115 is tightened during sight set-up, a plurality of circumferentially spaced apart slots 302 provide a slot 302 at a convenient location for radial entrance of cable 300 into its stored position.

Enhanced light-gathering capability for fiber optic sights is desired during periods of low-light. For example, before daybreak, an archer can benefit from a cable 300 being structured to acquire as much ambient light as possible to visibly illuminate an aim point. However, during a bright afternoon, that cable arrangement may direct too much light to the individual aim points. Too much light emanating from an aim point actually reduces the precision that can be provided by each aim point. Therefore, sometimes, a mechanism may be provided to reduce the length of cable 300 that is effective to gather ambient light.

As illustrated in FIGS. 10 and 11, a cover or shield may be provided to block a variable amount of light from impinging through an open side of wheel 115 and onto the length of fiber optic cable 300 that is spooled-up and stored inside. Although other mechanisms may be envisioned, a cover can be affixed to a wheel 115 with a simple friction fit around the wheel perimeter.

The shield generally indicated at 304 in FIG. 10 is a pin wheel cover, with a rotatable opaque face 308. Cover 304 may be installed on wheel 115 subsequent to sight set-up. Light transmitting apertures 312 can be positioned in- or out-of registration with opaque panels 316. Light transmitting panels that cooperate with apertures 312 are circumferentially disposed between opaque panels 316. When apertures 312 and panels 316 are in-registration, all light can be blocked (by face 308 and panels 316), from impinging through the open side of wheel 115 and onto the length of cable 300 that is spooled-up inside the wheel 115. When out-of registration, approximately one-half of the open side area of wheel 115 can admit light to impinge onto the spooled-up length of cable 300. An archer may select a desired amount of aperture/panel registration, and the corresponding aim point brightness.

The cover generally indicated at 320 in FIG. 11 is a multi-segment variably-overlapping shell. In the fully-deployed condition illustrated in FIG. 11, cover 320 resembles a pill bug or armadillo in a defensive position. Individual opaque shell elements 324 may be spread circumferentially from their fully-open position, which is circumferentially stacked over base opaque element 328. Cover 320 provides a larger range in light gathering area that can be either exposed, or shielded, compared to cover 304. Therefore, an archer may select any desired amount from a larger range of aim point illumination that is provided by cover 320.

Wobble of a sight pin aim point during sight adjustment may be reduced by increasing a ratio of the length of a threaded aperture to the diameter of a drive screw shaft that is journalled inside that cooperating threaded aperture. It is believed that certain commercially available sights have a carriage thickness of less than about 0.200 inches. Carriage thickness is limited by desired sight aim point proximity (without resorting to bent pin arms). A conventional screw shaft might be made from a length of #6 screw shaft, having a major diameter of 0.138 inches. A smallest-reasonable diameter drive shaft is believed to be a #4 screw, which has a major diameter of 0.112 inches. Therefore, the largest ratio of threaded aperture length-to-shaft diameter of such devices is about 1.79 (or 0.2/0.112).

With reference again to the exemplary embodiment in FIG. 8, dowel 168 has a length (in a direction along the length axis 332 of its cooperating drive screw shaft), of about 0.75 inches. Dowel 164 and dowel 172 each have a length (in a direction along the length axes 336 and 340 of their respective cooperating drive screw shafts), of about 0.575 inches. The drive screw shafts are each made from lengths of #6 screw shaft, and have a major diameter of 0.138 inches. Therefore, the illustrated embodiment has ratios of threaded length-to-shaft diameter of about 5.4 and 4.2, respectively. Preferred embodiments will have a ratio of threaded length-to-shaft diameter of about 3 or more (although sometimes even less). More preferred embodiments will have a ratio of threaded length-to-shaft diameter in excess of about 4.

It is envisioned that a telescopic arrangement between structures carried on adjacent carriages (as illustrated) is not required. That is, it is contemplated that pin carriages with thicknesses that provide preferred threaded length-to-shaft diameter ratios may be structured to move in parallel tracks past portions of one another (without penetrating each other), and still provide pin aim points that are disposed on a fixed common plane of operation (e.g. indicated by pin orientation axis 128 in FIG. 3) inside a guard. The distance between adjacent pin aim points for such alternative carriage construction will not be limited by carriage thickness, but can sometimes be controlled by sight pin thickness or diameter. For example, the screw drives may be aligned transverse to the guard, and individual carriages may have a front surface aligned in a common transverse plane. Transversely-extending fixed-length sight pins (of various individual length) can be affixed to the front surfaces of respective carriages to dispose their respective aim points in a common fixed vertical plane of operation.

While the invention has been described in particular with reference to certain illustrated embodiments, such is not intended to limit the scope of the invention. The present invention may be embodied in other specific forms without departing from its spirit or essential characteristics. The described embodiments are to be considered as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus, comprising:

a plurality of sight pins, a portion of each sight pin establishing a respective pin aim point for a designated sight-in distance;

a guard disposed as a perimeter inside of which said plurality of sight pins operate, said perimeter defining an aperture through which an archer views a target; wherein:

a first sight pin is structurally coupled with said guard effective to maintain a first pin aim point, of said first sight pin, at a substantially fixed location with respect to said perimeter as said first sight pin is adjusted in elevation; and linkage within said apparatus is structured and arranged to assure that the relative location of a second sight pin aim point is simultaneously changed, with respect to said perimeter, as said first sight pin is adjusted in elevation.

2. The apparatus according to claim 1, wherein:

said fixed location is disposed along a sight axis passing substantially though the middle of said aperture.

3. The apparatus according to claim 1, wherein:

said guard defines an aperture with a substantially circular cross-section area; and said first sight pin is disposed substantially at the center of said cross-section area.

4. The apparatus according to claim 1, wherein:

said guard is affixed to elevation-adjustable structure associated with said first sight pin.

5. The apparatus according to claim 1, further comprising:
a bubble level disposed inside said perimeter.

6. The apparatus according to claim 1, further comprising:
a cant-indicating pendulum structured to depend from a top portion of said guard in vertical alignment along a sight axis with a plurality of individual pin aim points when an archery bow, on which said sight is installed, is properly oriented to aim a drawn arrow.

7. The apparatus according to claim 6, further comprising:
a magnet structured for disposition at a first position to resist motion of said pendulum, and for disposition at a second position to permit motion of said pendulum.

8. The apparatus according to claim 6, wherein:
said cant-indicating pendulum is offset from said aim points, in a sight axis direction, effective to provide a visual yaw feedback to an archer.

9. The apparatus according to claim 1, further comprising:
a lens coupled to said guard effective to resist passage of an object through said housing in a sight-axis direction.

10. The apparatus according to claim 9, wherein:
said lens comprises a magnifying lens.

11. The apparatus according to claim 1, wherein:
said guard is carried on a first pin arm that is adjustable in elevation by a screw mechanism associated with a cage; and
said screw mechanism is structured and arranged such that rotation of said screw mechanism causes an equal vertical displacement of said first pin arm and said guard.

12. The apparatus according to claim 11, wherein:
structure associated with a vertical displacement of said guard is biased into engagement with anti-rotation structure at a first position effective to resist rotation of said guard about a length axis of said screw mechanism as said screw mechanism is adjusted in a first direction; and
structure associated with said vertical displacement of said guard is biased into engagement with anti-rotation structure at a second position effective to resist rotation of said guard about a length axis of said screw mechanism as said screw mechanism is adjusted in a second direction.

13. The apparatus according to claim 11, wherein:
said guard is biased into engagement with first anti-rotation structure at a first position effective to resist rotation of said guard about a length axis of said screw mechanism as said screw mechanism is adjusted in a first direction.

14. The apparatus according to claim 13, wherein:
said first anti-rotation structure comprises a cage element.

15. The apparatus according to claim 13, wherein:
said first pin arm is biased into engagement with second anti-rotation structure at a second position effective to resist rotation of said guard about a length axis of said screw mechanism as said screw mechanism is adjusted in a second direction.

16. The apparatus according to claim 15, wherein:
said second anti-rotation structure comprises a cage element.

17. The apparatus according to claim 11, wherein:
said screw mechanism comprises an elongate and internally threaded dowel element affixed to a first pin arm, said dowel element extending transversely to a pin arm length axis of said first pin arm for reception of said dowel element in translating penetration through a portion of a cooperating second pin arm during operation of said screw mechanism.

18. The apparatus according to claim 1, further comprising:
a mechanism operable to adjust windage and global elevation of said sight pins as a group; and
fiber optic elements structured to visually accentuate individual pin aim points; wherein
a vertical adjustment of each sight pin may be effected individually to establish a plurality of aim points corresponding to respective target distances; and
said guard substantially encloses a volume in which said sight pins operate.

19. An archery sight, comprising:
a guard;
a first sight pin arm structured to dispose a first pin aim point inside said guard and at a selected elevation on a fixed plane of operation;
a second sight pin arm structured to dispose a second pin aim point inside said guard and at a selected elevation on said fixed plane, said first sight pin arm and said second sight pin arm being fixed in length to hold said first pin aim point and said second pin aim point in registration on said fixed plane;
a screw mechanism structured to adjust the elevation of said first aim point, said screw mechanism comprising a threaded shaft journalled inside a cooperating threaded aperture through said first sight pin arm, a ratio of threaded aperture length-to-shaft diameter being greater than about 4; and
a cant-indicating device associated with said guard and operable to provide a visible feedback to an archer when said fixed plane is disposed in a vertical orientation.

20. An archery sight, comprising:
a guard;
a first sight pin comprising a first aim point disposed inside a perimeter defined by said guard;
a threaded shaft coupled to said first sight pin to cause adjustment of a sight-in elevation of said first sight pin by rotation of said threaded shaft, said first sight pin being affixed to said guard so that said rotation of said threaded shaft causes simultaneous vertical displacement of said first sight pin and said guard and maintains an aim point of said first sight pin at a fixed location with respect to said perimeter;
a second sight pin comprising a second aim point disposed inside said perimeter, said second sight pin being coupled to said sight by a mechanism structured to permit motion of said second aim point with respect to said perimeter; and
said sight is structured and arranged such that said rotation of said threaded shaft to change an elevation of said first sight pin, with respect to a global adjustment member on which said sight is carried, simultaneously causes a displacement of said second aim point with respect to said perimeter.

* * * * *